United States Patent [19]

Lingl, Jr.

[11] Patent Number: 4,744,750

[45] **Date of Patent: * May 17, 1988**

[54] TUNNEL KILN SYSTEM FOR COOLING THE UNDERSIDE OF A TRAIN OF KILN CARS

[76] Inventor: Hans Lingl, Jr., An der Schiessmauer 46, D-7910 Neu-Ulm, Fed. Rep. of Germany

[ * ] Notice: The portion of the term of this patent subsequent to Feb. 2, 2005 has been disclaimed.

[21] Appl. No.: 11,948

[22] Filed: Feb. 6, 1987

Related U.S. Application Data

[63] Continuation-in-part of Ser. No. 930,924, Nov. 17, 1986, Pat. No. 4,722,682.

[30] Foreign Application Priority Data

Feb. 13, 1986 [DE] Fed. Rep. of Germany ..... 3604501

[51] Int. Cl.[4] ..... F27B 9/26

[52] U.S. Cl. ..... 432/137; 432/241

[58] Field of Search ..... 432/137, 241

[56] References Cited

U.S. PATENT DOCUMENTS

| | | | |
|---|---|---|---|
| 1,965,832 | 7/1934 | Hartford et al. | 432/137 |
| 2,191,438 | 2/1940 | Breeler | 432/137 |
| 4,069,010 | 1/1978 | Fay | 432/137 |
| 4,375,354 | 3/1983 | Henriksson | 432/241 |
| 4,421,481 | 12/1983 | Holz et al. | 432/137 |
| 4,482,314 | 11/1984 | Giese et al. | 432/137 |
| 4,504,221 | 3/1985 | Hartmann | 432/241 |
| 4,560,350 | 12/1985 | Doby | 432/137 |

FOREIGN PATENT DOCUMENTS 0086693 4/1983 European Pat. Off. .

*Primary Examiner*—Henry C. Yuen

*Attorney, Agent, or Firm*—Nixon & Vanderhye

[57] ABSTRACT

Intensive undercar cooling is achieved in the latter portion of a tunnel kiln by (a) a continuous undercar longitudinal cooling air flow or (b) by transverse undercar sub-chambers in which heat exchangers are used to set up local cooling connection currents within each sub-chamber. Air flows in the undercar channel are substantially prevented in the heat-up zone and up to about the middle of the firing zone. Pressure equalization is permitted with respect to the firing chamber thereabove but very little air will actually pass therebetween in the sensitive heat-up zone because there is no other substantial air passageway leading into or out of the sub-chambers formed by aprons depending from the kiln cars.

16 Claims, 3 Drawing Sheets

TUNNEL KILN SYSTEM FOR COOLING THE UNDERSIDE OF A TRAIN OF KILN CARS

This application is a continuation-in-part of my earlier copending U.S. patent application No. 930,924 filed Nov. 17, 1986 now U.S. Pat No. 4,722,682. The contents of this copending parent application are hereby incorporated by reference.

This invention is generally directed to method and apparatus for cooling the underside of a train of kiln cars located in a tunnel kiln. It includes specially adapted kiln cars as well as an especially adapted tunnel kiln and the system comprising such specially adapted kiln cars and kiln.

For various reasons, it is often necessary to insure that the underside of a kiln car is maintained in a relatively cooler atmosphere than the upper deck side (on which uncured ceramic materials are typically carried for firing in the kiln). For example, it may be necessary to achieve sufficient cooling to avoid overheating of mechanisms such as kiln car wheels or the like located beneath the deck of a kiln car.

In general, the foundation and lower side walls of the tunnel kiln may be cooled in an attempt to dissipate heat flowing through the deck of kiln cars to avoid such overheating. One typical prior art practice is to attempt cooling of the undercar channel by means of air drawn through the undercar channel from the exit end of the tunnel kiln toward its entrance end. The firing channel of the tunnel kiln is typically also flushed with gases flowing the same direction so that a pressure gradient develops in both channels (i.e., the firing channel located above the car decks and the undercar channel located therebelow) from the exit towards the entrance end of the tunnel.

However, because there are different gas flows and/or flow resistances in the two different channels, the pressure gradient is different as a function of distance along the tunnel thereby leading to leakage air flows between the two channels. Such leakage air flows between the two channels is a situation which is often preferably avoided by appropriate measures so as to avoid undue heating of the undercar channel (or undue cooling of the firing channel).

In my related parent application, I describe a system which permits controlled cooling along a tunnel kiln utilizing convection currents in divided cooling sub-chambers formed along the length of the undercar channel. By blocking the longitudinal flow of air along the undercar channel, it is possible to permit local pressure equalizations vertically to the upper firing channel and thus eliminate the need for the traditional horizontal pressure seal along the tunnel length.

However the formation of cooling sub-chambers along the undercar channel requires the installation of lateral divider walls and other modifications to the existing depressed undercar tunnel which may, as a practical matter, limit its use to newly constructed tunnel kilns.

Now, however, I have discovered an arrangement for improved undercar cooling which can be economically retro-fitted to existing tunnel kilns —while still avoiding the requirement for the traditional horizontal seal arrangement. In brief summary, this new discovery is based on an understanding that undercar cooling is actually needed only towards the end of the firing zone and in the cooling zone.

In the past it has typically been assumed that the undercar tunnel must be cooled throughout the entire length of the kiln. However, if the heat-up zone is not cooled, then lateral dividers depending from the kiln cars are sufficient in and of themselves to prevent longitudinal gas flow in the undercar channel (and thus permit pressure equalization to the firing channel without substantial "leakage" flows)—if the undercar tunnel floor is raised in this zone of the kiln at least up to the rails and preferably up to the lower edge of the lateral dividers on the cars. The remainder of the already existing undercar tunnel can then be modified so as to permit air extraction/input at the new "end" of the depressed undercar channel (located midway in the kiln).

In the heat-up zone, leaks between undercar channel and firing channel have especially adverse effects. Here, there is a great risk of leakage because a negative pressure prevails in the firing channel. For example, the ware to be fired would be cooled in the heat-up zone by false air from the undercar channel so that ware heat-up would take place comparatively late, and then too fast, in the firing zone. On the other hand, false air leaks to the firing channel would increase the gas mass flow without providing more heat in the heat-up zone so that the heat requirements of the kiln would increase accordingly. While air leakage is thus seen to be a potential problem, there is typically no real need for undercar cooling in the heat-up zone.

In the firing zone, there is normally no risk of false air leakage from the under channel because the firing zone is traversed without any substantial change of pressure.

In the cooling zone of the tunnel kiln, false air from the undercar channel is by no means a drawback. However the cooling zone (and in the latter portions of the firing zone) is typically where undercar cooling is needed the most. In fact, the temperature rise in the undercar channel progresses in such a manner that the highest temperature will be reached only toward the end of the firing zone, (or even the end of the cooling zone in the case of kilns traversed very quickly).

It will be understood that the sides of kiln cars typically travel in close proximity to the tunnel side walls. One conventional method for sealing the moving kiln car sides to the kiln side walls is to provide aprons along the longitudinal car sides which dip into sand-filled channels in skirting of the kiln side walls such that the sand forms a closed barrier extending the length of the kiln. Transverse joints between successive kiln cars may be sealed by means of conventional elastic material cords (e.g., see Lingl Leaflet F045/3 dated July 1982).

Although the purpose of such prior sand barriers is to substantially prevent pressure equalization between the undercar channel and the firing channel, it is far from a perfect seal. In the first place, for design and cost reasons, the depth to which such aprons dip into the sand must be comparatively small. In addition, the sand must be made comparatively course so that it will be heavy enough not to be blown out of the barrier area and entrained in a moving gas flow. As a result, the sand barrier actually is permeable to gas and provides a far from perfect seal. Furthermore, cooling air in such a continuous undercar channel is drawn all the way along from the exit to the entrance end of the kiln—and thus through the heat-up zone as well where such cooling is not really needed.

Another prior approach (EP-OS No. 0,086,693) uses a kiln car including a box-like structure open at the bottom and provided with sheet metal aprons extending all about the car. At the entrance to the tunnel kiln, each car is lowered into a running fluid bath which provides a continuous hydraulic seal below the car train. The fluid is circulated under the cars for cooling purposes. However, in addition to requiring lowering and lifting devices for each kiln car at the entrance and exit of the tunnel kiln, the cooling fluid is entrained in one large continuous container so that it is not possible to control the degree of cooling as a function of position along the tunnel kiln. For example, heat is undesirably removed even in the initial heat-up zone of the tunnel kiln where undercar cooling is neither necessary nor desirable (e.g., because it ultimately removes heat from the firing channel which, at this point, is contrary to the desired purpose of getting the top-side of the car and material carried thereon up to kiln curing temperatures as fast as possible).

I have now discovered a novel method and apparatus for undercar cooling of kiln cars in a tunnel kiln which permits the heat exchange or cooling performance to be varied both locally and in degree while minimizing the entrance of leakage air into the firing channel—especially in the heat-up zone.

In general, in accordance with this invention, interchannel pressure gradients are reduced (especially in the heat-up zone) so as to minimize air leakage flows between the firing channel and the undercar channel. Furthermore, this invention provides intensive undercar cooling in the areas of high undercar temperatures where it is actually needed.

My prior U.S. application No. 930,924 now U.S. Pat. No. 4,722,682, discloses one approach for minimizing air leakage flows. It uses, in part, depending aprons in conjunction with upstanding partitions in a depressed undercar channel forming sub-chambers with cooling heat exchangers therein. To further provide intensive undercar cooling towards the latter half of the undercar channel (i.e., from mid firing zone through the cooling zone), I have now discovered that a continuous undercar channel (e.g., depressed continuously below such car aprons) may be used for a longitudinal cooling air flow in this latter portion of the tunnel kiln. Surprisingly, it has been found that, in spite of the aprons depending from kiln cars in the upper part of this depressed undercar channel, the longitudinally flowing cooling air does reach the lower parts of the kiln cars so as to achieve the necessary cooling effect.

If desired, the depressed undercar channel provided only along the latter portion of the kiln may be provided with plural sub-chambers disposed therealong beneath the intended track of a train of kiln cars (i.e., similar to the system described in my parent application). Gas flows to and from each of the sub-chambers in this alternate embodiment are substantially isolated and prevented except for that required to equalize pressure between the sub-chamber and the section of the firing channel located directly thereabove. A heat exchanger provides cooling within the sub-chamber thus setting up convection currents within the sub-chamber which tend to cool the underside of the kiln car located directly thereabove. Individual sub-chambers may be cooled differently as a function of prevailing temperature. However, since there is no substantial gas flow into or out of each sub-chamber, there is no substantial leakage gas flow between the cooling channel and the firing channel. This alternate embodiment thus generally utilizes the techniques described in my copending parent application 930,924,now U.S. Pat. No. 4,722,682.

Preferably, a radiation blocking structure is employed in the pressure equalization passage located between the cooling channel and the firing channel so as to prevent direct radiation transfers of heat energy from the firing channel into the cooling channel.

The advantages of this invention can be achieved, at least in part, because intensive undercar cooling is limited to the latter portion of the kiln (e.g., mid firing zone through cooling zone) where expected undercar temperatures make such cooling necessary—while minimizing inter-channel leakage in the initial portion of the kiln (e.g., the heat-up zone).

As a result, sand-filled channels or other types of attempted seals between the firing channel and the undercar cooling channel are no longer required. And, as an added advantage, the undercar channel can be cooled at different rates in different sections or sub-chambers as a function of position along the tunnel kiln. Furthermore, the kiln cars can continue to be transported along a rail system in the same plane both inside and outside the tunnel kiln so that lifting or lowering devices are avoided. This greatly facilitates movement and circulation of the kiln cars with conventional apparatus and existing facilities which can be retrofitted or converted after the fact to practice the present invention.

These as well as other objects and advantages of this invention will be more completely understood and appreciated by carefully studying the following detailed description of a presently preferred exemplary embodiment taken in conjunction with the drawings, of which:

Figure 4:
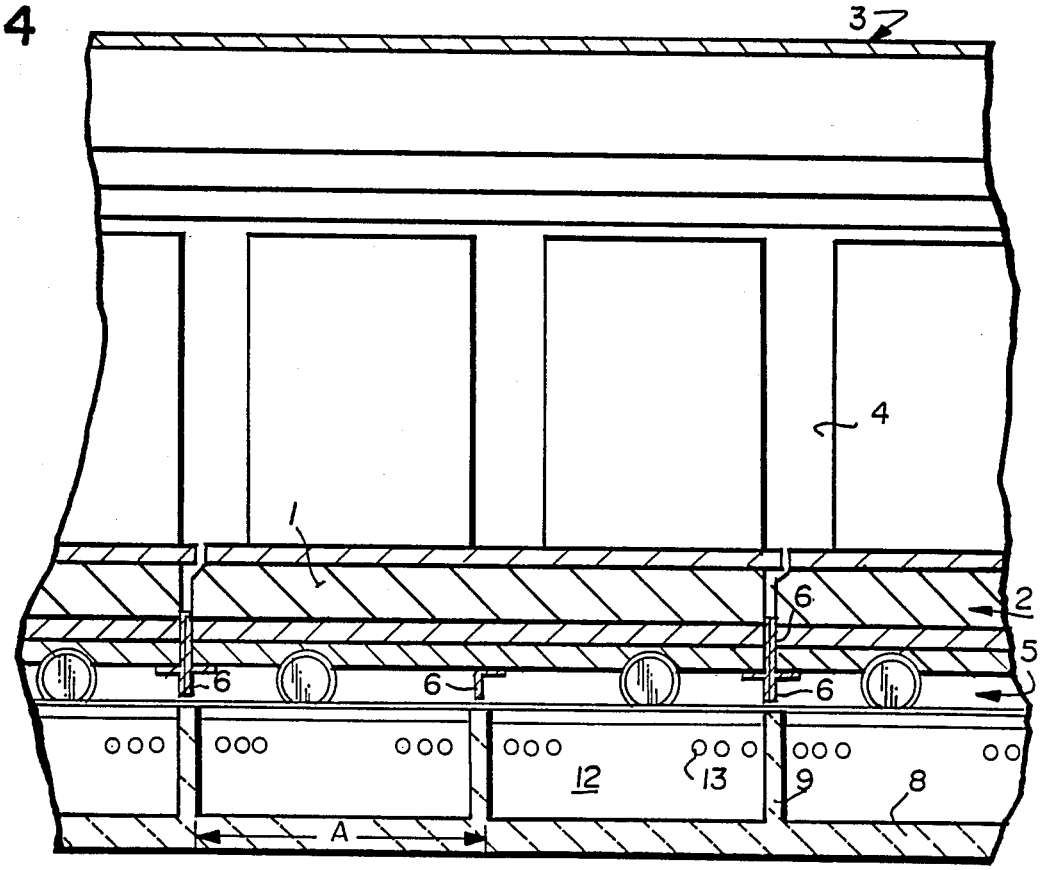
FIG. 4 is a schematic longitudinal section through the tunnel kiln of FIG. 3.

Referring to the drawings, a kiln car train 2 includes a plurality of closely spaced rail-mounted kiln cars 1 which is typically pushed through a tunnel kiln 3. The deck of the kiln cars passes in close adjacency to the lower side walls of the tunnel kiln thus "closing" the bottom of a firing channel 4 and separating it from an undercar cooling channel 5. In the exemplary embodiments, the end of each kiln car 1 is provided with an apron 6 (e.g., made of ordinary steel plate) which depends downwardly toward the rails 10. If desired, an additional apron 6 may be disposed at other predetermined locations such as depicted at FIG. 4 at the middle of each kiln car. The aprons 6 are disposed with little (e.g., 10 millimeters or less) if any clearance with respect to the kiln walls 7 so that they act as seals. A projecting course 15 of soft insulating refractory material is disposed along the side of each kiln car 1 so as to pass with very little clearance from a projecting course 14 located on the kiln wall 7. This interdigitated structure of refractory material serves as a radiation barrier so as to prevent the transfer of heat energy by direct radiation from the firing chamber 4 to the cooling chamber 5.

In an area, beginning at the most, in the middle of the firing zone and extending over a substantial length of the cooling zone, the foundation 8 of the kiln 3 takes the form of a trough with the floor of the foundation 8 lowered far enough to provide a continuous, depressed undercar channel 5' below the aprons 6.

Figure 1:
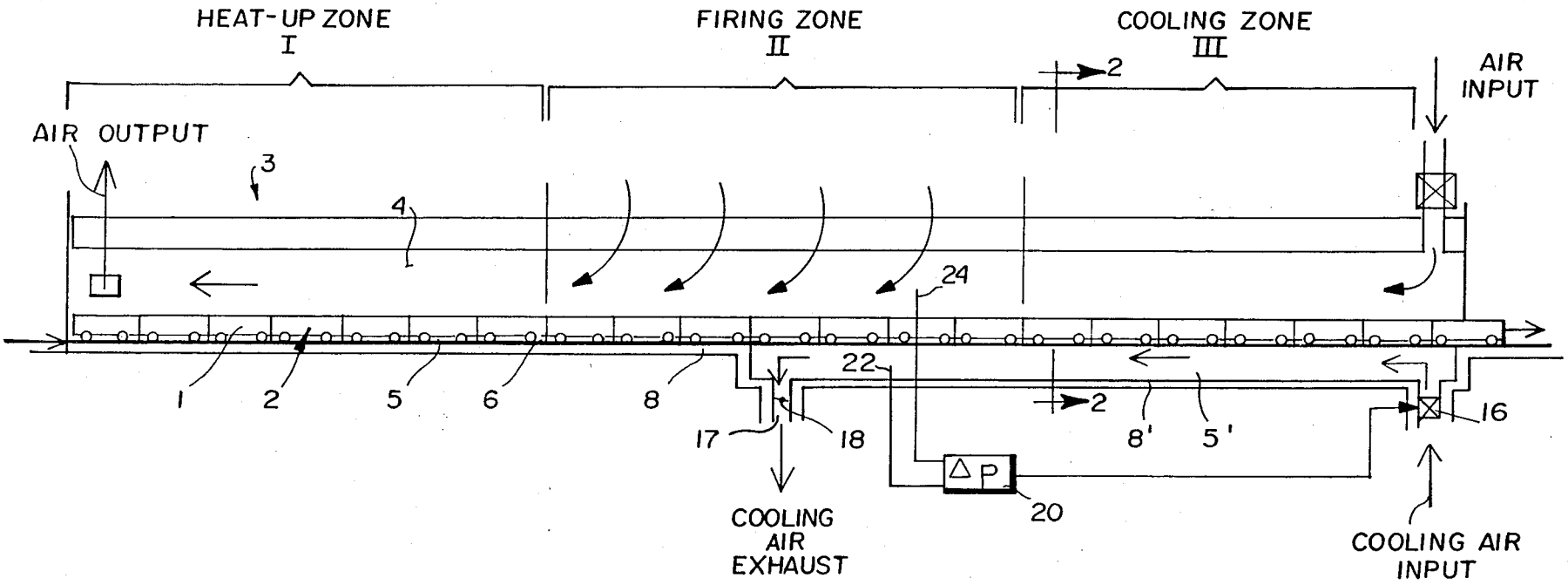
FIG. 1 is a schematic longitudinal cross-sectional view through a tunnel kiln modified so as to practice this invention.
Figure 2:
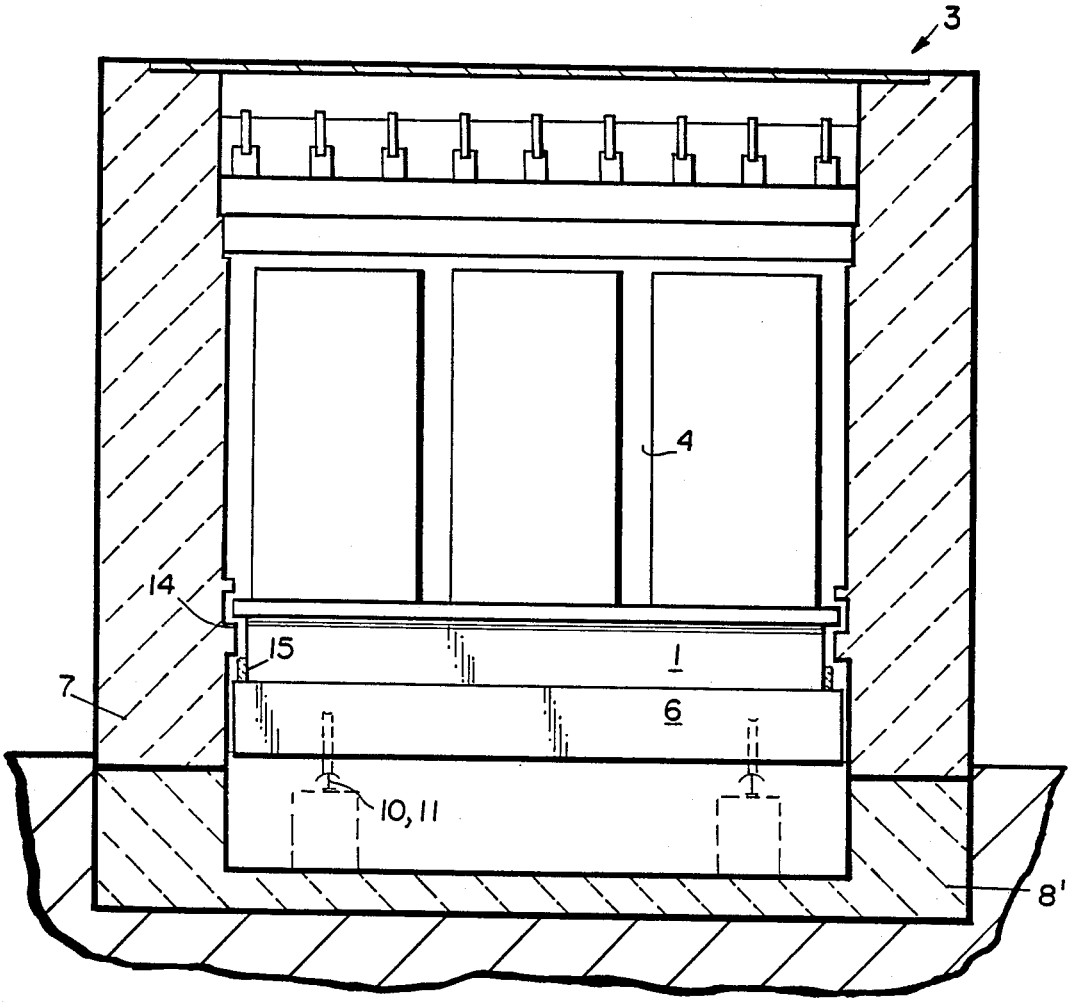
FIG. 2 is a schematic cross-sectional view through the tunnel kiln of FIG. 1 illustrating the depressed undercar channel below depending aprons on a train of kiln cars in a kiln system adapted to practice this invention.

According to one embodiment of the invention (FIGS. 1 and 2), a fan 16 is disposed in the depressed undercar channel 5' at the exit end of the cooling zone III by means of which cooling air is blown into the depressed undercar channel 5' which can be exhausted through an opening 17 in the area of the firing zone II. The opening 17 can be closed by means of a damper 18 which can be controlled either manually or as a function of the temperature in the depressed undercar channel 5'. The output of the fan 16 may be controlled by a conventional controller as a function of the pressure difference between the depressed undercar channel 5' and the firing channel 4 in the area of the firing zone II as sensed by pressure sensor 22 and 24. This pressure difference should be kept as constant as possible. Depending aprons 6 extend substantially to the kiln floor in the heat-up zone (through to the start of depressed channel 5') so as to prevent substantial longitudinal air flows in this section of the kiln.

Figure 3:
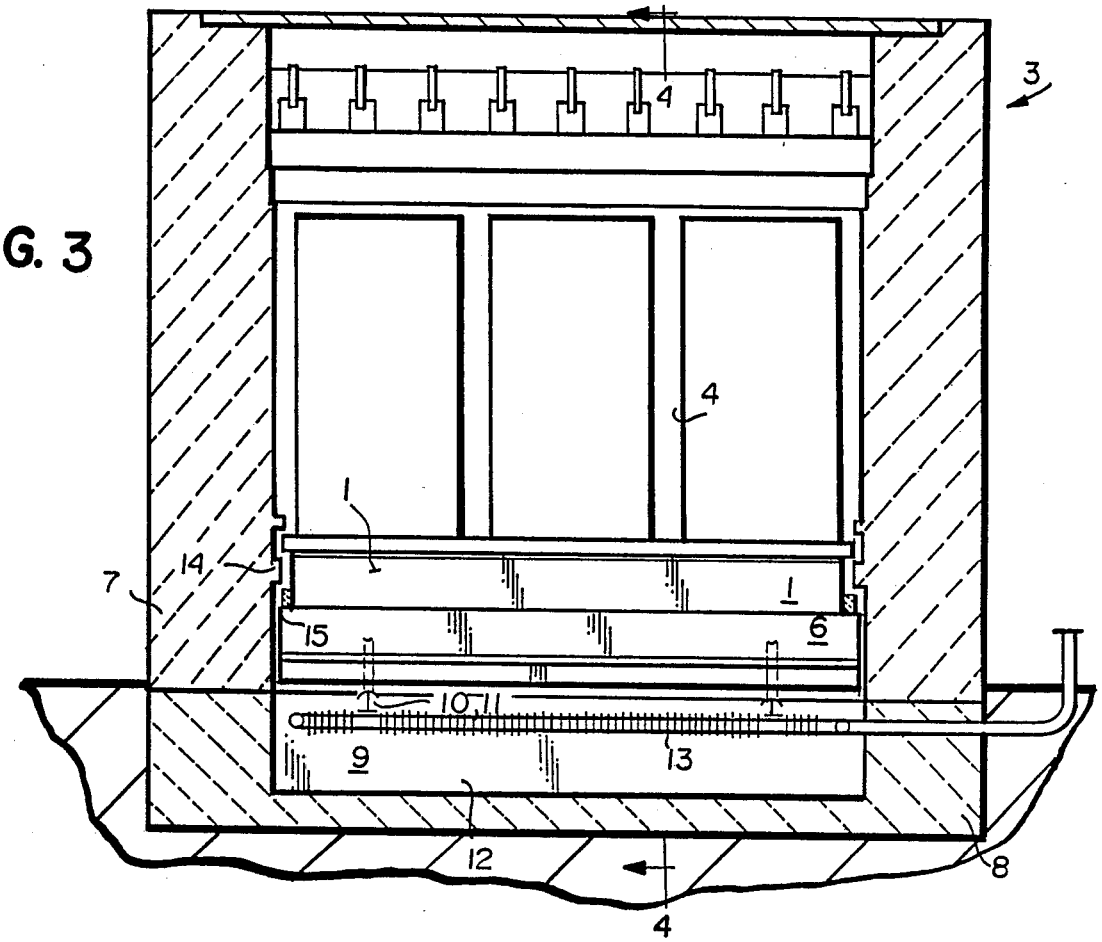
FIG. 3 is a schematic cross-sectional view through the tunnel kiln of FIG. 1 modified so as to practice a second embodiment of this invention.

According to another embodiment of the invention (shown in FIGS. 3 and 4 using techniques discussed in my copending parent application No. 930,924), the depressed undercar channel 5' is divided into a plurality of individual sections or sub-chambers by means of partitions 9 spaced apart by distance A which corresponds to the distance between aprons 6 (or a multiple thereof). As will be understood in a typical "intermittent" kiln, the train of kiln cars is intermittently advanced by a predetermined increment of distance (e.g., distance A).

The transverse partitions 9 extend upwardly to the level of the track rail tops so that the clearance between the bottom of aprons 6 and the top of partitions 9 (or the floor of channel 5 in the heat-up zone) is nonexistent or only very small (e.g., 10 millimeters or less) so as to effectively result in a "tight" seal preventing substantial gas flows therethrough.

The kiln car rails 10 are supported by means of conventional beams 11 to bridge the sub-chambers 12 formed by this type of structure. Directly below the beams 11 are heat exchanger cooling pipes 13 disposed so as to set up a natural circulation of air by convection currents within each of the sub-chambers 12. By controlling the passage of coolant fluid within heat exchange pipes 13, the intensity of such convection air currents can be controlled in sections corresponding to the length of each sub-chamber or multiples thereof.

Since there is no attempt to make a gas tight seal vertically between firing chamber 4 and cooling chamber 5 along the sides of the tunnel kiln, pressure equalization can freely take place between the firing channel 4 and the undercar channels 5 and 5'. However, since there is otherwise no significant air supplied to or removed from the undercar channel 5 (nor any of the effectively isolated sub-chambers 12 in the alternate embodiment), there is no significant leakage air flow. In other words, the very small gap that may still exist between aprons 6, partitions 9 and kiln wall 7 (and the kiln floor in the heat-up zone) does not permit any significant longitudinal gas flow along the undercar channel 5 (or 5' in the case of the FIGS. 3, 4 embodiment).

While only two exemplary embodiments of this invention have been described in detail, those skilled in the art will recognize that many modifications and variations may be made in these embodiments while yet retaining many of the novel features and advantages of this invention. All such modifications and variations are intended to be included within the scope of the appended claims.

What is claimed is:

1. A system for cooling the underside of kiln cars located in a tunnel kiln, said system comprising:

a plurality of kiln cars;

a tunnel kiln including a heat-up zone, a firing zone and a cooling zone and having elongated bottom, side and top structures defining an elongated tunnel through which said kiln cars may be passed in train formation;

said kiln cars including a deck portion on which uncured articles may be stacked for kiln curing and which deck portion passes in close proximity to said side structures so as to define an upper kiln firing tunnel channel thereabove and a lower tunnel chamber therebelow;

said lower tunnel chanber in at least said heat-up zone being divided transversely into plural sub-chambers by transversely situated dividers; wherein a portion of said tunnel kiln, subjacent to said lower tunnel chambers in at least said cooling zone also defines a depressed undercar channel; and wherein said system further comprises, cooling means disposed to transfer heat from said depressed undercar channel.

2. A system as in claim 1 wherein the cooling means comprises means for forcing an air flow longitudinally along said depressed undercar channel.

3. A system as in claim 1 wherein said depressed undercar channel is separated into sub-chambers by transversely situated dividers disposed to mate with the dividers disposed on said kiln cars and said cooling means comprises heat exchangers disposed in at least some of said sub-chambers and each exchanger having a cooling liquid circuit therethrough and air contact fins therealong for setting up convection cooling currents of air within its respective said sub-chamber.

4. A system as in claim 1 wherein a gas flow path extends from the upper kiln firing tunnel downwardly past the side structures and kiln car decks to/from each of said sub-chambers so as to provide pressure equalization therebetween.

5. A tunnel kiln having a heat-up zone, firing zone and cooling zone and adapted for controlled undercar cooling and including elongated bottom side and top structures through which kiln cars may be passed in train formation, said kiln comprising:

a depressed undercar channel defined by a portion of said bottom and side structures of said kiln and extending longitudinally only along a latter portion of said kiln, which latter portion includes at least part of one of said firing and cooling zones; and cooling means disposed to transfer heat from said depressed undercar channel, wherein said cooling means comprises means for forcing an air flow longitudinally along said depressed undercar channel.

6. A tunnel kiln having a heat-up zone, firing zone and cooling zone and adapted for controlled undercar cooling and including elongated bottom, side and top structures through which kiln cars may be passed in train formation, said kiln comprising:

a depressed undercar channel defined by a portion of said bottom and side structures of said kiln and extending longitudinally only along a latter portion of said kiln, which latter portion includes at least part of one of said firing and cooling zones; and cooling means disposed to transfer heat from said depressed undercar channel, wherein said depressed under channel is separated into sub-chambers by transversely situated dividers disposed to mate with dividers disposed on said kiln cars, and wherein said cooling means comprising heat exchangers disposed in at least some of said sub-chambers, each said exchanger having a cooling liquid circuit therethrough and air contact fins therealong for setting up convection cooling currents of air within its respective said sub-chamber.

7. A tunnel kiln as in claim 5 or 6 wherein said depressed undercar chanel extends from approximately the mid-portion of said firing zone and substantially through said cooling zone.

8. Apparatus for undercar cooling of kiln cars in a tunnel kiln having walls and a foundation floor, said kiln also having a firing channel defined above the kiln cars, and an undercar channel below the kiln cars and defined by the foundation floor and the kiln walls, said undercar cooling being accomplished by means of an air flow in the undercar channel, said apparatus comprising:

aprons (6) disposed on the kiln cars which project toward the foundation floor and disposed only at the end of at least one of a succession of kiln cars (1) in siding contact with the kiln walls (7) and projecting down toward and touching, or almost touching, the foundation floor (8) of the kiln (3) and forming sections of the undercar channel at intervals corresponding to the length of one kiln car;

the foundation floor of the kiln being lowered in the cooling area of the kiln (39), forming a depressed undercar channel (5') in the shape of a trough below the area of the aprons (6), and a cooling device (13/16) cooling the undersides of the kiln cars disposed in the depressed undercar channel.

9. Apparatus as in claim 8 wherein said cooling device takes the form of a fan (16) disposed at the exit of the cooling zone (III) by means of which air is blown into the continuously depressed undercar channel (5') which is exhausted through a closable opening (17) at the entrance of the depressed undercar channel (5').

10. Apparatus as in claim 9 wherein said opening (17) includes a damper (8), which can be closed in response to a predetermined temperature in the depressed undercar channel (5').

11. Apparatus as in claim 9 including means (20) for controlling the output of the said fan (16) in response to a pressure difference between the depressed undercar channel (5') and the firing channel (4) in the firing zone (II), which pressure difference is minimized by such control.

12. Apparatus as in claim 8 wherein said cooling device comprises cooling pipes (13) forming a heat exchanger and disposed in the trough-shaped depressed undercar channel (5').

13. Apparatus as in claim 12 wherein said trough-shaped depressed undercar channel (5') is divided into a plurality of individual troughs (12) by means of partitions (9) disposed at intervals (A) corresponding to the car advance or a multiple of the car advance of an intermittent kiln (3), with cooling pipes (13) being provided in each of the individual troughs.

14. Apparatus as in claim 13 wherein said kiln includes a rail on which the kiln cars are supported and said partitions (9) extend up to rail top level such that the clearance between the aprons (6) and the partitions (9) is minimized.

15. Apparatus as in claim 12 further comprising: a radiation barrier (14, 15) permitting pressure equalization to take place between the firing channel (4) and the undercar channel (5, 5') disposed between the longitudinal sides of the kiln cars (1) and the kiln walls (7).

16. Apparatus as in claim 15 wherein said radiation barrier comprises at least one projecting course (15) of soft insulating refractories on the longitudinal sides of the kiln cars (1) and at least one other such projecting course (14) on the kiln walls (7), the said two projecting courses (14, 15) being disposed with only minimal clearance between them.

* * * * *